US009622638B2

(12) United States Patent
Butts et al.

(10) Patent No.: US 9,622,638 B2
(45) **Date of Patent: *Apr. 18, 2017**

(54) HANDHELD CLEANING DEVICE WITH ELONGATED HANDLE FOR USE WITH DISPOSABLE CLEANING TOWEL

(71) Applicant: Butler Home Products, LLC, Marlborough, MA (US)

(72) Inventors: Mark Butts, Atlanta, GA (US); Jeff Tadin, Canton, GA (US)

(73) Assignee: BUTLER HOME PRODUCTS, LLC, Marlborough, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/174,210

(22) Filed: Jun. 6, 2016

(65) Prior Publication Data

US 2016/0278602 A1 Sep. 29, 2016

Related U.S. Application Data

(63) Continuation of application No. 14/727,350, filed on Jun. 1, 2015, now Pat. No. 9,370,293.
(Continued)

(51) Int. Cl.
*A47L 13/46* (2006.01)
*A47L 13/16* (2006.01)
(Continued)

(52) U.S. Cl.
CPC ..... *A47L 13/46* (2013.01); *A47K 10/16* (2013.01); *A47K 11/10* (2013.01); *A47L 13/16* (2013.01)

(58) Field of Classification Search
CPC ..... A47K 10/16; A47L 13/16; A47L 13/258; A47L 13/46
See application file for complete search history.

(56) References Cited

U.S. PATENT DOCUMENTS 5,630,243 A * 5/1997 Federico ..... A47K 11/10 15/104.94
6,158,077 A * 12/2000 Wenger ..... A47K 7/08 15/145
(Continued)

*Primary Examiner* — Randall Chin
(74) *Attorney, Agent, or Firm* — McCarter & English, LLP

(57) ABSTRACT

A cleaning device operable for use with a disposable cleaning towel is provided. The cleaning device includes a handle, a head, first and second clamps, and an ejector. The handle extends between a proximal end portion and a distal end portion. The head is disposed relative to the distal end portion of the handle. The head defines a head surface over which the disposable cleaning towel is fixed during use of the cleaning device. The head defines a head cavity and a head aperture extending between the head cavity and the head mating surface. The first and second clamps are disposed relative to the head, and each are selectively moveable between a closed position and an open position. In their respective closed positions, at least a portion of each of the first and second clamps is operable to abut the head surface and hold the cleaning towel in place. In their respective open positions, each of the first and second clamps is positioned away from the head surface. The ejector is disposed relative to the head, and is selectively moveable between a stowed position and a deployed position. In the stowed position, the ejector is disposed entirely within the head cavity. In the deployed position, at least a portion of the ejector extends through the head aperture and extends outward relative to a plane defined by the head surface.

9 Claims, 6 Drawing Sheets

Related U.S. Application Data

(60) Provisional application No. 62/006,673, filed on Jun. 2, 2014.

(51) Int. Cl.
*A47K 10/16* (2006.01)
*A47K 11/10* (2006.01)

(56) References Cited

U.S. PATENT DOCUMENTS 6,269,516 B1 * 8/2001 Saatjian ..... A47K 7/08 15/147.1
6,272,716 B1 * 8/2001 Thornton ..... A47K 7/08 15/150
7,032,270 B2 * 4/2006 Vitantonio ..... A47K 17/00 15/104.94
7,059,008 B2 * 6/2006 Morgan ..... A47K 11/10 15/147.1
7,386,910 B2 * 6/2008 Minkler ..... A47L 13/16 15/145
7,581,276 B2 * 9/2009 Endo ..... A47K 11/10 15/209.1

* cited by examiner

HANDHELD CLEANING DEVICE WITH ELONGATED HANDLE FOR USE WITH DISPOSABLE CLEANING TOWEL

This application claims priority under 35 U.S.C. §120 to U.S. patent application Ser. No. 14/727,350 filed on Jun. 1, 2015, now U.S. Pat. No. 9,370,293, which claims priority under 35 U.S.C. §119(e) to U.S. Provisional Application Ser. No. 62/006,673 filed on Jun. 2, 2014, the contents of each of which are hereby incorporated in their entirety.

BACKGROUND

The present invention relates to a cleaning device, and more particularly relates to a handheld cleaning device having an elongated handle for use with a disposable cleaning towel.

The cleaning of household surfaces (e.g., bathroom surfaces, kitchen surfaces, etc.) is often done using a disposable cleaning towel (e.g., a paper towel, a cloth towel, etc.). The cleaning towel can be provided in a dry condition, or it can be pre-wetted with a cleaning solution. The cleaning towel can be effective at cleaning surfaces, but can be problematic in that use of the cleaning towel can cause a user to experience skin irritation, fingernail irritation, and/or dry skin. Further, use of the cleaning towel typically requires the user to touch the cleaning towel after it has been soiled with materials that may be undesirable and/or unhealthy to touch. Aspects of the present invention are directed to these and other problems.

SUMMARY OF THE INVENTION

According to one aspect of the present invention, a cleaning device operable for use with a disposable cleaning towel is provided. The cleaning device includes a handle, a head, first and second clamps, and an ejector. The handle extends between a proximal end portion for gripping and a distal end portion. The head is disposed at the distal end portion of the handle. The head defines a head surface over which the disposable cleaning towel is fixed by the first and second clamps during use of the cleaning device. The head defines a head cavity and a head aperture extending between the head cavity and the head surface. The first and second clamps are disposed relative to the head, and each are selectively moveable between a closed position and an open position. In their respective closed positions, at least a portion of each of the first and second clamps is operable to abut the head surface and hold the cleaning towel on the head surface. In their respective open positions, each of the first and second clamps is positioned away from the head surface. The ejector is disposed relative to the head, and is selectively moveable between a stowed position and a deployed position. In the stowed position, the ejector is disposed entirely within the head cavity. In the deployed position, at least a portion of the ejector extends through the head aperture and extends outward relative to a plane defined by the head surface.

In addition to, or as an alternative to, one or more of the features described above, further embodiments of the present invention can include one or more of the following features, individually or in combination:

- the head is substantially wedge-shaped;
- the first and second clamps each include a clamp arm that extends between a first end portion and an opposing second end portion, and a clamp pad that is positionally fixed to the second end portion of the clamp arm; and the first end portion of each clamp arm is pivotably connected to the second end portion of the handle;
- the ejector is an elongated shaft-like member that extends in a lengthwise direction; the handle extends between its first and second end portions along a handle axis; and the ejector is substantially aligned with the handle axis;
- the first and second clamps and the ejector are operable to be moved by an actuation arm that is disposed within an internal handle cavity of the handle; and
- the actuation arm is integrally connected with the ejector.

These and other aspects of the present invention will become apparent in light of the drawings and detailed description provided below.

DETAILED DESCRIPTION OF THE INVENTION

Figure 1:
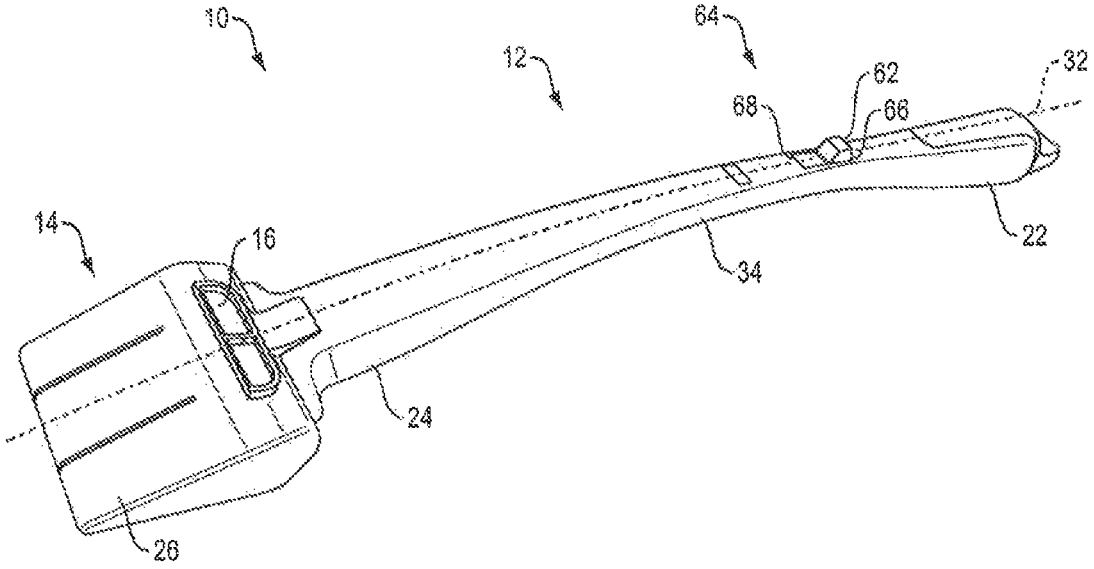
FIG. 1 illustrates an isometric view of an embodiment of the present cleaning device, showing one of the first and second clamps in the closed position, and the ejector in its stowed position.

Referring to FIGS. 1-6, the present disclosure describes a handheld cleaning device 10 operable for use with a cleaning towel (not shown).

The present disclosure describes aspects of the present invention with reference to the exemplary embodiment illustrated in the drawings; however, the present invention is not limited to the exemplary embodiment illustrated in the drawings.

The present disclosure uses the terms "mate," "abut," and variations thereof, to describe one or more features. The term "mate," and variations thereof, are used herein to indicate that a first feature is disposed relative to a second feature (e.g., fit on or together with a second feature). The term "abut," and variations thereof, are used herein to indicate either that a first feature, such as a clamp, is in direct contact with a second feature, such as a surface of the head of the cleaning device, or that a first feature, such as a clamp, is almost in direct contact with a second feature, such as the head of the cleaning device, and is separated from the second feature only a small distance, such as the thickness of a disposable cleaning towel held in place by the clamp.

Figure 2:
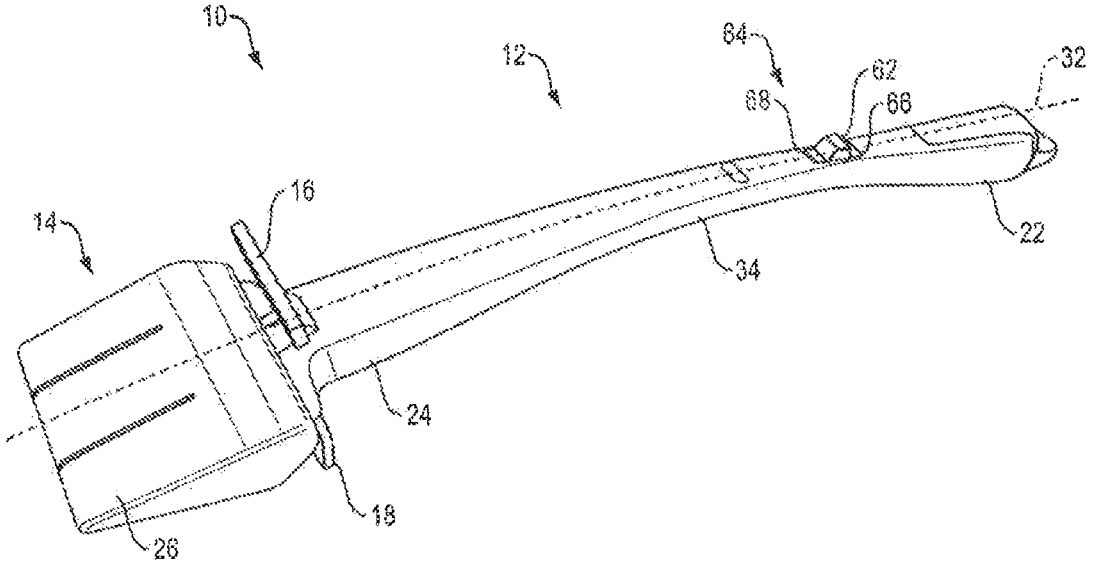
FIG. 2 illustrates an isometric view of the cleaning device of FIG. 1, showing the first and second clamps in their respective open positions, and the ejector in its stowed position.
Figure 3:
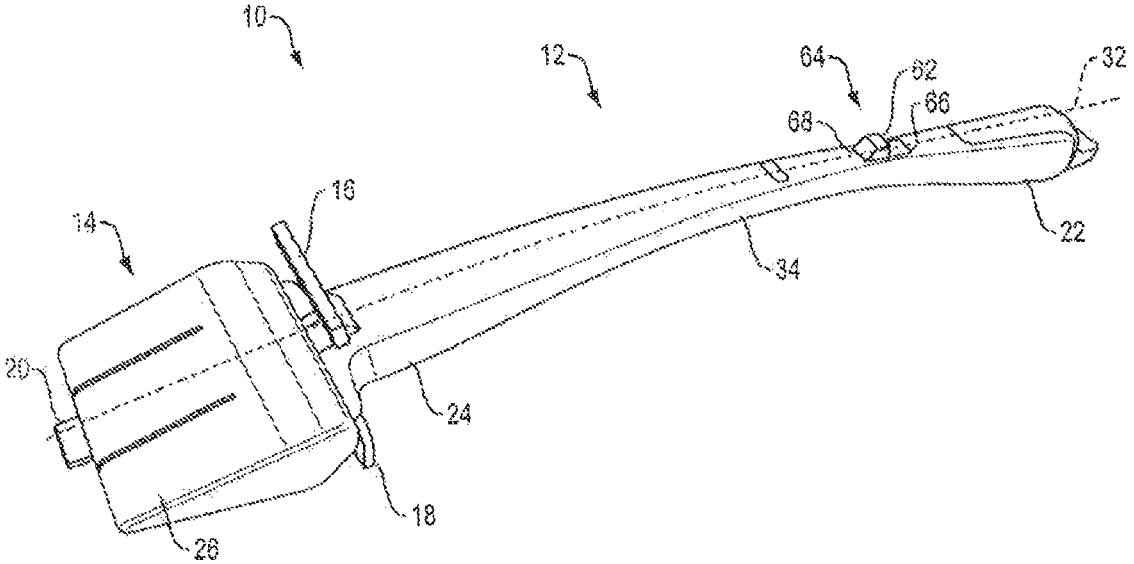
FIG. 3 illustrates an isometric view of the cleaning device of FIG. 1, showing the first and second clamps in their respective open positions, and the ejector in its deployed position.
Figure 4:
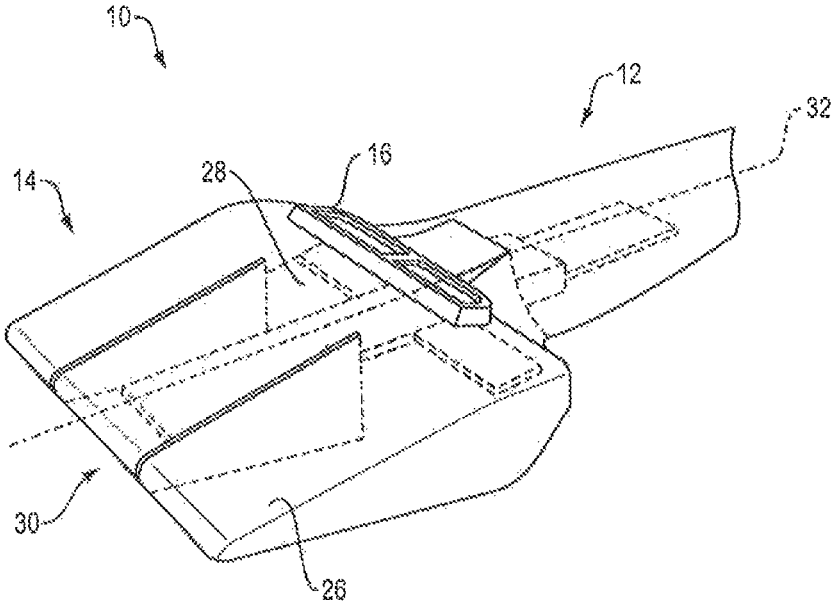
FIG. 4 illustrates an partial isometric view of the cleaning device of FIG. 1, showing one of the first and second clamps in the closed position, and the ejector in its stowed position.
Figure 5:
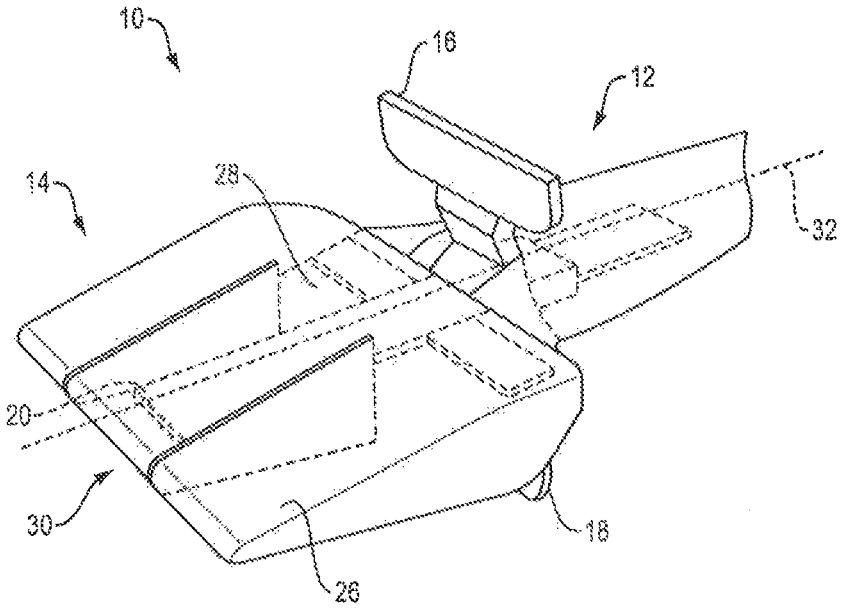
FIG. 5 illustrates a partial isometric view of the cleaning device of FIG. 1, showing the first and second clamps in their respective open positions, and the ejector in its stowed position.
Figure 6:
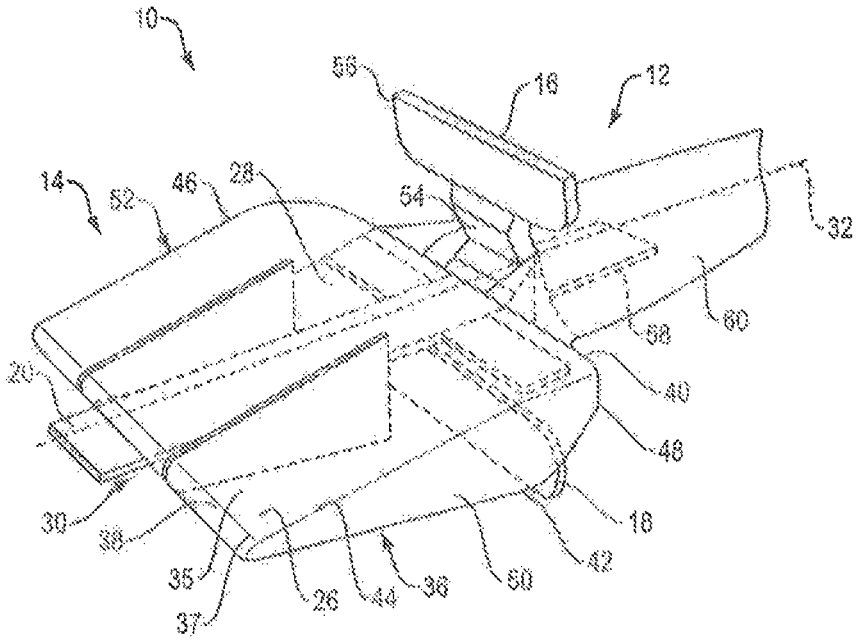
FIG. 6 illustrates a partial isometric view of the cleaning device of FIG. 1, showing the first and second clamps in their respective open positions, and the ejector in its deployed position.

Referring still to FIGS. 1-6, the cleaning device 10 includes an elongated handle 12, a head 14, a first clamp 16, a second clamp 18 (see FIGS. 2, 3, 5 and 6), and an ejector 20 (see FIGS. 3, 5, and 6). The handle 12 extends between a proximal end portion 22 used to grip the device (see FIGS. 1-3) and a distal end portion 24 (see FIGS. 1-3). The head 14 is fixed to the distal end portion 24 of the handle 12. The head 14 defines an outer head surface 26 with which a disposable cleaning towel (not shown) can be mated during use of the cleaning device 10. The head 14 also defines an internal head cavity 28 (see FIGS. 4-6), and a head aperture 30 (see FIGS. 4-6) that extends through the end of head mating surface 26 and provides means to extend an ejector from the head cavity 28. The first and second clamps 16, 18 are disposed relative to the head 14, and each are selectively moveable between a closed position (see FIGS. 1 and 4) and an open position (see FIGS. 2, 3, 5, and 6). In their respective closed positions, and in the absence of a cleaning towel, at least a portion of each of the first and second clamps 16, 18 abuts the head mating surface 26. In their respective open positions, each of the first and second clamps 16, 18 is positioned away from the head surface 26. That is, in their respective open positions, the first and second clamps 16, 18 do not abut the head surface 26. The ejector 20 is also disposed relative to the head 14, and is selectively movable between a stowed position (see FIGS. 1, 2, 4, and 5) and a deployed position (see FIGS. 3 and 6). In its stowed position, the ejector 20 is disposed entirely within the head cavity 28. In its deployed position, at least a portion of the ejector 20 extends through the head aperture 30, and thus extends outward from the head 14.

The handle 12 of the cleaning device 10 can be configured in various different ways. In the illustrated embodiment, the handle 12 extends between its proximal and distal end portions 22, 24 (see FIGS. 1-3) along a slightly curved, lengthwise-extending handle axis 32. The handle 12 has an ergonomic shape that makes it suitable to be held by a user using at least one hand. In some embodiments, the handle 12 can be sized such that it can be comfortably held by a user using two hands. That is, for example, a distance extending between the proximal and distal end portions 22, 24 can be sufficiently large so as to provide sufficient room for a user to comfortably hold an intermediate portion 34 (see FIGS. 1-3) of the handle 12 (i.e., a portion extending between the proximal and distal end portions 22, 24 with a first hand (e.g., a left hand), while simultaneously holding the first end portion 22 of the handle 12 with a second hand (e.g., a right hand).

The handle 12 can be made of one or more materials that are known in the art, such as a plastic. The materials can be selected such that the handle 12 is relatively rigid, and thus suitable for translating movement of the handle 12 to the head 14. An example of a material that may be used is the rigid plastic polypropylene.

Referring to FIG. 6, the head 14 of the cleaning device 10 can be configured in various different ways. In the illustrated embodiment, the head 14 is substantially wedge-shaped. The head mating surface 26 includes a top portion 35, a bottom portion 36, and an intermediate portion 38 at the tip of the head extending between the top and bottom portions 35, 36. The head mating surface 26 extends in lengthwise directions between first and second edges 37, 40 and extends in a widthwise direction between third and fourth edges 44, 46. The top and bottom portions 35, 36 of the head mating surface 26 are positioned relative to one another such that an acute angle extends between a plane defined by the top portion 35 and a plane defined by the bottom portion 36. The head 14 further includes a head end surface 48 that extends in a heightwise direction between the second edge 40 and bottom edge 42 of the head 14; a first head side surface 50; and an opposing second head side surface 52. The head mating surface 26, together with the head end surface 48 and the first and second head side surfaces 50, 52 at least partially surround the head cavity 28 in which the ejector 20 is at least partially disposed. The head aperture 30 extends between the head cavity 28 and the intermediate portion 38 of the head mating surface 26.

The head 14 can be made of one or more materials that are known in the art. The materials can be selected so that the head 14 is at least partially flexible (e.g., flexible relative to the rigid handle 12), and thus operable to at least partially bend and/or form to a contour of a cleaning surface (e.g., a kitchen counter surface, a toilet bowl surface, etc.). Examples of acceptable materials include urethane foam, EVA foam, PVC foam, latex foam, synthetic rubber foam, and neoprene foam. If desired, the head 14 may also be made from a rigid material, such as polypropylene or other relatively rigid plastic.

Referring still to FIG. 6, the first and second clamps 16, 18 can be configured in various different ways. In the illustrated embodiment, the first and second clamps 16, 18 each include a clamp arm 54 that extends between a first end portion and an opposing second end portion, and a clamp pad 56 that is positionally fixed to the second end portion of the clamp arm 54. The first end portion of each clamp arm 54 is pivotably connected to the distal end portion 24 (see FIGS. 1-3) of the handle 12. The clamp arm 54 of each of the first and second clamps 16, 18 (and thus the first and second clamps 16, 18 as a whole) are configured to pivot about a widthwise-extending axis (i.e., an axis that is generally perpendicular to the handle axis 32). The clamp pad 56 is the portion that abuts the head surface 26 when the first and second clamps 16, 18 are in their respective closed positions and a cleaning towel is absent. The first and second clamps are used to hold a cleaning towel (not shown) in place on the head 14 during use.

The ejector 20 can be configured in various different ways. In the illustrated embodiment, the ejector 20 is an elongated shaft-like member that extends in a lengthwise direction. The ejector 20 is substantially aligned with the handle axis 32. The ejector 20 is configured such that it is operable to slidably extend through the head aperture 30 as it (the ejector 20) is moved from its stowed position (see FIGS. 1, 2, 4, and 5) to its deployed position (see FIGS. 3 and 6).

The first and second clamps 16, 18 and the ejector 20 can be made of one or more materials that are known in the art. The materials can be selected such that the first and second clamps 16, 18 and the ejector 20 are relatively rigid, such as a relatively rigid plastic.

Referring still to FIG. 6, the movement of the first and second clamps 16, 18 between their respective closed positions (see FIGS. 1 and 4) and open positions (see FIGS. 2, 3, 5, and 6), and the movement of the ejector 20 between its stowed position (see FIGS. 1, 2, 4, and 5) and deployed position (see FIGS. 3 and 6), can be achieved in various different ways. In the illustrated embodiments, the first and second clamps 16, 18 and the ejector 20 are moved by an actuation arm 58 that is disposed within an internal handle cavity 60 of the handle 12. The actuation arm 58 is an elongated shaft-like member that extends in a lengthwise direction. The actuation arm 58 is substantially aligned with the handle axis 32, and is integrally connected with the ejector 20. Thus, in this embodiment, the ejector 20 and the actuation arm 58 form a unitary structure.

In the illustrated embodiment, the actuation arm 58 is operable to slidably engage portions of the handle 12 that define the handle cavity 60. The actuation arm 58 is moveable between a first position, a second position, and a third position. Movement of the actuation arm 58 between its first, second, and third positions is operable to cause movement of the first and second clamps 16, 18 between their respective open positions and closed positions, and is operable to cause movement of the ejector 20 between its stowed position (see FIGS. 1, 2, 4, and 5) and its deployed position (see FIGS. 3 and 6). When the actuation arm 58 is in its first position (see FIG. 1) (referred to hereinafter as the "clamped configuration" of the cleaning device 10), the first and second clamps 16, 18 will be in their respective closed positions, and the ejector 20 will be in its stowed position. When the actuation arm 58 is in its second position (see FIG. 2) (referred to hereinafter as the "unclamped configuration" of the cleaning device 10), the first and second clamps 16, 18 will be in their respective open positions, and the ejector 20 will be in its stowed position. When the actuation arm 58 is in its third position (see FIG. 3) (referred to hereinafter as the "eject configuration" of the cleaning device 10), the first and second clamps 16, 18 will be in the respective open positions, and the ejector 20 will be in its deployed position.

In the illustrated embodiment, during movement of the actuation arm 58 between its first position (see FIG. 1) and its second position (see FIG. 2), the actuation arm 58 engages the respective clamp arm 54 of each of the first and second clamps 16, 18. This in turn causes each of the first and second clamps 16, 18 to pivot about the first end portions of their respective clamp arms 54, and thus causes each of the first and second clamps 16, 18 to pivot between its respective closed position (see, e.g., FIG. 1) and its respective open position (see, e.g., FIG. 2). During movement of the actuation arm 58 between its second position (see FIG. 1) and its third position (see FIG. 2), the actuation arm 58, being integrally connected to the ejector 20, causes the ejector 20 to move between its stowed position (see FIGS. 1, 2, 4, and 5) and its deployed position (see FIGS. 3 and 6), as described above.

Referring to FIGS. 1-3, in the illustrated embodiment, movement of the actuation arm 58 (see FIGS. 4-6) between its first, second, and third positions is effected using a trigger 62 that extends radially outward from the actuation arm 58. The trigger 62 is connected to the actuation arm 58 such that movement of the trigger 62 causes corresponding movement of the actuation arm 58. The trigger 62 is disposed proximate the proximal end portion 22 of the handle 12, and it extends along a handle channel 64 that is defined on an outer surface of the handle 12. The handle channel 64 extends in a lengthwise direction between a first channel end 66 and a second channel end 68. The trigger 62 abuts the first channel end 66 when the actuation arm 58 is in its first position (see FIG. 1); the trigger 62 is disposed between the first and second channel ends 66, 68 when the actuation arm 58 is in its second position (see FIG. 2); and the trigger 62 abuts the second channel end 68 when the actuation arm 58 is in its third position (see FIG. 3). The trigger 62 is configured to be moved by a user, for example, using the thumb of the hand that is holding the first end portion 22 of the handle 12.

The cleaning device 10 may initially be provided to a user in the clamped configuration (see FIGS. 1 and 4). To use the cleaning device, the user can move the trigger 62 to reconfigure the cleaning device 10 from the clamped configured to the unclamped configuration (see FIGS. 2 and 5). In the unclamped configuration, the user can mate a cleaning towel (not shown) to the head surface 26 along the top 35 and bottom 36 of the head 14. The user can then move the trigger 62 to return the cleaning device 10 to the clamped configuration. In the clamped configuration, the first and second clamps 16, 18 will clamp the cleaning towel to the top and bottom portions 35, 36 of the head surface 26, respectively, and will thus prevent the cleaning towel from coming loose from the cleaning device 10 during use. After use of the cleaning device 10, the user can dispose of the cleaning towel by returning the cleaning device 10 to the unclamped configuration. In some instances, the soiled cleaning towel may cling to the head surface 26 even after the cleaning device 10 is returned to the unclamped configuration. In such instances, the user can move the trigger 62 to reconfigure the cleaning device 10 from the unclamped configuration to the eject configuration (see FIGS. 3 and 6). The ejector 20 will move from its stowed position (see FIG. 2) to its deployed position (see FIG. 3), and will eject (i.e., forcibly remove) the soiled cleaning towel from the head mating surface 26. The user can thus avoid the need to touch the soiled cleaning towel during the disposal process.

While several embodiments have been disclosed, it will be apparent to those of ordinary skill in the art that aspects of the present invention include additional embodiments and implementations. Accordingly, aspects of the present invention are not to be restricted based upon the description above. It will also be apparent to those of ordinary skill in the art that variations and modifications can be made without departing from the true scope of the present disclosure. For example, in some instances, one or more features disclosed in connection with one embodiment can be used alone or in combination with one or more features of one or more other embodiments.

What is claimed is:

1. A cleaning device operable for use with a disposable cleaning towel, comprising:

a handle extending between a proximal end portion and a distal end portion;

a head fixed to the distal end portion of the handle, the head defining an outer head surface, a head cavity and a head aperture;

first and second clamps disposed relative to the head, the first and second clamps each being selectively moveable between a closed position and an open position, wherein in their respective closed positions, at least a portion of each of the first and second clamps are positioned to face toward the outer head surface and hold a disposable cleaning towel on the head, and wherein in their respective open positions, each of the first and second clamps is positioned away from the outer head surface to release the cleaning towel; and an ejector disposed relative to the head, the ejector being selectively moveable between a stowed position and a deployed position, wherein in the stowed position, the ejector is disposed at least partially within the head cavity, and wherein in the deployed position, at least a portion of the ejector extends from within the head cavity through the head aperture.

2. The cleaning device of claim 1, wherein the head is substantially wedge-shaped.

3. The cleaning device of claim 2, wherein the head is made from a material selected from the group consisting of urethane foam, EVA foam, PVC foam, latex foam, synthetic rubber foam, neoprene foam or polypropylene.

4. The cleaning device of claim 1, further comprising an actuation arm disposed within an internal handle cavity of the handle, wherein the first and second clamps and the ejector are operable to be moved by the actuation arm.

5. The cleaning device of claim 4, wherein the actuation arm is movable between a first actuation arm position in which the first and second clamps are in the closed position and the ejector is in the stowed position, a second actuation arm position in which the first and second clamps are in the open position and the ejector is in the stowed position, and a third actuation arm position in which the first and second clamps are in the open position and the ejector is in the deployed position.

6. The cleaning device of claim 5, wherein a trigger is connected to the actuation arm.

7. A cleaning device operable for use with a disposable cleaning towel, comprising:

a handle extending between a proximal end portion and a distal end portion;

a head fixed to the distal end portion of the handle, the head defining a head surface, a head cavity and a head aperture;

first and second clamps disposed relative to the head, the first and second clamps each being selectively moveable between a closed position and an open position, wherein in their respective closed positions, at least a portion of each of the first and second clamps are positioned to hold a disposable cleaning towel on the head, and wherein in their respective open positions, each of the first and second clamps is positioned away from the head surface to release the cleaning towel; and an ejector disposed relative to the head, the ejector being selectively moveable between a stowed position and a deployed position, wherein in the stowed position, the ejector is disposed at least partially within the head cavity, and wherein in the deployed position, at least a portion of the ejector extends from within the head cavity through the head aperture;

wherein the first and second clamps each include a clamp arm that extends between a first end portion and an opposing second end portion, and a clamp pad that is positionally fixed to the second end portion of the clamp arm; and wherein the first end portion of each clamp arm is pivotably connected to the second end portion of the handle.

8. A cleaning device operable for use with a disposable cleaning towel, comprising:

a handle extending between a proximal end portion and a distal end portion;

a head fixed to the distal end portion of the handle, the head defining a head surface, a head cavity and a head aperture;

first and second clamps disposed relative to the head, the first and second clamps each being selectively moveable between a closed position and an open position, wherein in their respective closed positions, at least a portion of each of the first and second clamps are positioned to hold a disposable cleaning towel on the head, and wherein in their respective open positions, each of the first and second clamps is positioned away from the head surface to release the cleaning towel; and an ejector disposed relative to the head, the ejector being selectively moveable between a stowed position and a deployed position, wherein in the stowed position, the ejector is disposed at least partially within the head cavity, and wherein in the deployed position, at least a portion of the ejector extends from within the head cavity through the head aperture;

wherein the ejector is an elongated shaft-like member that extends in a lengthwise direction and wherein the ejector is substantially aligned with an axis of the handle.

9. The cleaning device of claim 8, wherein the actuation arm is integrally connected with the ejector.

* * * * *